US006044913A

United States Patent [19]

Stehling et al.

[11] Patent Number: 6,044,913

[45] Date of Patent: Apr. 4, 2000

[54] FIRE EXTINGUISHING SYSTEMS AND METHODS

[75] Inventors: Henry J. Stehling; J. Paul Rouse; David L. Dunston, all of Irving; Harry Boling, III, Garland; Dennis D. Garrett, Dallas; Jerry L. Williams, Keller, all of Tex.

[73] Assignee: Twenty-First Century International Fire Equipment and Services Corporation, Irving, Tex.

[21] Appl. No.: 09/248,266

[22] Filed: Feb. 11, 1999

Related U.S. Application Data

[63] Continuation of application No. 08/961,495, Oct. 30, 1997, Pat. No. 5,871,057, which is a continuation of application No. 08/460,722, Jun. 2, 1995, Pat. No. 5,697,450, which is a continuation-in-part of application No. 08/242,109, May 13, 1994, abandoned, which is a continuation-in-part of application No. 08/233,582, Apr. 26, 1994, abandoned, which is a continuation-in-part of application No. 08/052, 842, Apr. 28, 1993, abandoned.

[51] Int. Cl.[7] ..... A62C 3/00

[52] U.S. Cl. ..... 169/65; 367/199

[58] Field of Search ..... 169/65, 56; 126/42; 340/500, 501, 532; 367/197, 199; 219/412, 413, 414

[56] References Cited

U.S. PATENT DOCUMENTS

| | | |
|---|---|---|
| 3,582,671 | 6/1971 | Ott . |
| 3,653,443 | 4/1972 | Dockery . |
| 3,970,987 | 7/1976 | Kolm . |
| 4,011,486 | 3/1977 | Oulton . |
| 4,171,944 | 10/1979 | Hirschmann . |
| 4,258,291 | 3/1981 | Scott et al. . |
| 4,349,747 | 9/1982 | Hasegawa . |
| 4,356,870 | 11/1982 | Gaylord et al. . |
| 4,365,238 | 12/1982 | Kollin . |
| 4,432,041 | 2/1984 | Pfisterer et al. . |
| 4,476,554 | 10/1984 | Smith et al. . |
| 4,524,304 | 6/1985 | Todd . |
| 4,602,256 | 7/1986 | Kago et al. . |
| 4,630,248 | 12/1986 | Scott . |
| 4,773,485 | 9/1988 | Silverman . |
| 4,800,293 | 1/1989 | Miller . |
| 4,830,116 | 5/1989 | Walden et al. . |
| 4,834,188 | 5/1989 | Silverman . |
| 4,887,674 | 12/1989 | Galosky et al. . |
| 4,901,056 | 2/1990 | Bellavia et al. . |
| 4,910,501 | 3/1990 | Montoya . |
| 4,934,478 | 6/1990 | Melocik et al. . |
| 4,947,148 | 8/1990 | MacDonald . |
| 4,973,881 | 11/1990 | Haraden et al. . |
| 4,991,145 | 2/1991 | Goldstein et al. . |
| 5,012,223 | 4/1991 | Griebell et al. . |
| 5,019,935 | 5/1991 | Nakamura . |
| 5,127,479 | 7/1992 | Stehling et al. . |
| 5,148,158 | 9/1992 | Shah . |
| 5,162,777 | 11/1992 | Kolbatz . |
| 5,177,461 | 1/1993 | Budzyna et al. . |
| 5,207,276 | 5/1993 | Scofield . |
| 5,351,760 | 10/1994 | Tabor, Jr. . |
| 5,508,568 | 4/1996 | Mammen . |

*Primary Examiner*—Gary C. Hoge
*Attorney, Agent, or Firm*—Millen, White, Zelano & Branigan

[57] ABSTRACT

In a preferred embodiment, a fire extinguishing system for suppressing fires on cook stoves, fryers or other heating or heated devices with fire suppressant dispensed through nozzles is powered by batteries which provide current for both a detection circuit including a pair of heat sensors and control circuitry and current for a gas or electric house current shut-off. Preferably, the shut-off is operated acoustically upon sounding of an audible alarm which emits a signal to which the shut off is acoustically tuned. Preferably, the heat sensors are diodes but, in alterative embodiments may be thermistors or active temperature sensors. While a wireless link, such as an acoustical link, is preferred between the control circuitry and shut-off, a wired link may also be used. In order to facilitate mounting of both the heat sensors and nozzles, magnetic housings are utilized which retain studs extending from tees, 90 degree elbows or both. A heat sensor housing is secured to the magnetic mount by magnetic force, which heat sensor housing is in turn held securely proximate the heat source at appropriate locations.

8 Claims, 9 Drawing Sheets

NOTE: ALL DIODES ARE IN4148 OR IN914.

FIRE EXTINGUISHING SYSTEMS AND METHODS

CROSS-REFERENCE TO RELATED APPLICATIONS

This application is a continuation of U.S. patent application Ser. No. 08/961,495 filed Oct. 30, 1997, now U.S. Pat. No. 5,871,057 having the issue date of Feb. 16, 1999; which is a continuation of U.S. patent application Ser. No. 08/460,722 filed Jun. 2, 1995, now U.S. Pat. No. 5,697,450 issued Dec. 16, 1997; which is a continuation-in-part of application Ser. No. 08/242,109, filed May 13, 1994, now abandoned, entitled "FIRE EXTINGUISHING SYSTEM", which is a continuation-in-part of Ser. No. 08/233,582, now abandoned, filed Apr. 26, 1994, which is in turn a continuation-in-part of application Ser. No. 08/052,842, now abandoned, filed Apr. 28, 1993.

FIELD OF THE INVENTION

This invention relates to automatically operated fire extinguishing systems and methods. More particularly, this invention relates to automatically operated electrical fire extinguishing systems and methods especially useful for warning of and extinguishing fires occurring on commercial or residential cook stoves, fryers, ranges or other heating devices or heated devices.

BACKGROUND ART

U.S. Pat. Nos. 4,773,485, 4,834,188 and 5,127,479, each assigned to the assignee of the present invention, disclose systems for extinguishing fires which occur on residential cook stoves, fryers and ranges. While the systems disclosed in these patents have gained wide acceptance and function effectively to extinguish fires on residential cook stoves and ranges and fryers, these patents rely on an array of heat sensing elements coupled to one another with cables strung around the internal periphery of range hoods. Since these systems require at least some skill in mechanical assembly and require adjustments in cable length, they are systems which are somewhat difficult for the average home owner to install. Moreover, these systems are relatively expensive.

Attempts have been made to develop electronic systems which do not have the difficulties of cable systems. U.S. Pat. Nos. 4,830,116 and 4,887,674 are exemplary of such systems but the systems disclosed in these patents have not been commercialized. An impediment to the installation of electronic systems is their apparent complexity and utilization of house current as a source of electric power for the systems.

Other electronic systems are exemplified by U.S. Pat. Nos. 5,186,260 and 5,207,276; however, these systems rely on twisted insulated conductors which limit an alarm signal upon the insulation melting which is an irreversible system subject to degradation over time.

In addition, prior art arrangements are not easy to install and require drilling, measuring, screwing and bolting which procedures tend to discourage their installation.

In view of the aforementioned considerations, there is a need for a fire extinguishing system, suitable for commercial and residential cook stoves, fryers and ranges, as well as other heating and heated devices, which is very easy to install and is less expensive than the aforementioned, prior art systems as well as the electronic systems proposed in the patent literature.

SUMMARY OF THE INVENTION

It is a feature of the present invention to provide new and improved fire extinguishing systems for residential and commercial cook stoves, fryers and ranges which are relatively easy to install and are relatively inexpensive.

With this feature and other features in mind, in a preferred embodiment, the present invention is directed to a system for detecting and suppressing fires on cook stoves and fryers being energized by a source of gas or electric current. The system includes a heat sensor circuit comprised of one or more heat sensors which are connected to a control circuit. When the heat sensors detect an increased temperature representative of a fire, the control circuit sounds an audible alarm, an electrical output triggers the fire extinguisher valve discharging a fire extinguisher, and a general purpose contact closure output is activated.

In accordance with the preferred embodiment, a sonic activated cut-off assembly, triggered by the audible alarm, is placed between the burners and the source of gas or electric current to interrupt the flow of gas or electric current from the source to the burners. The fire extinguisher includes outlet nozzles for directing the fire extinguisher material towards the burners of the cook stove or fryer.

In accordance with another embodiment of the invention, the control circuit is hard wired to the cut-off assembly to interrupt gas or electric power to the stove or fryer.

In accordance with another aspect of the invention, a permanent magnet is used to retain a nozzle and heat sensor in proximity to a heating or heated device for the purpose of suppressing fire or excessive heat.

Upon further study of the specification and appended claims, further features and advantages of this invention will become apparent to those skilled in the art.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE DRAWING

Figure 1:
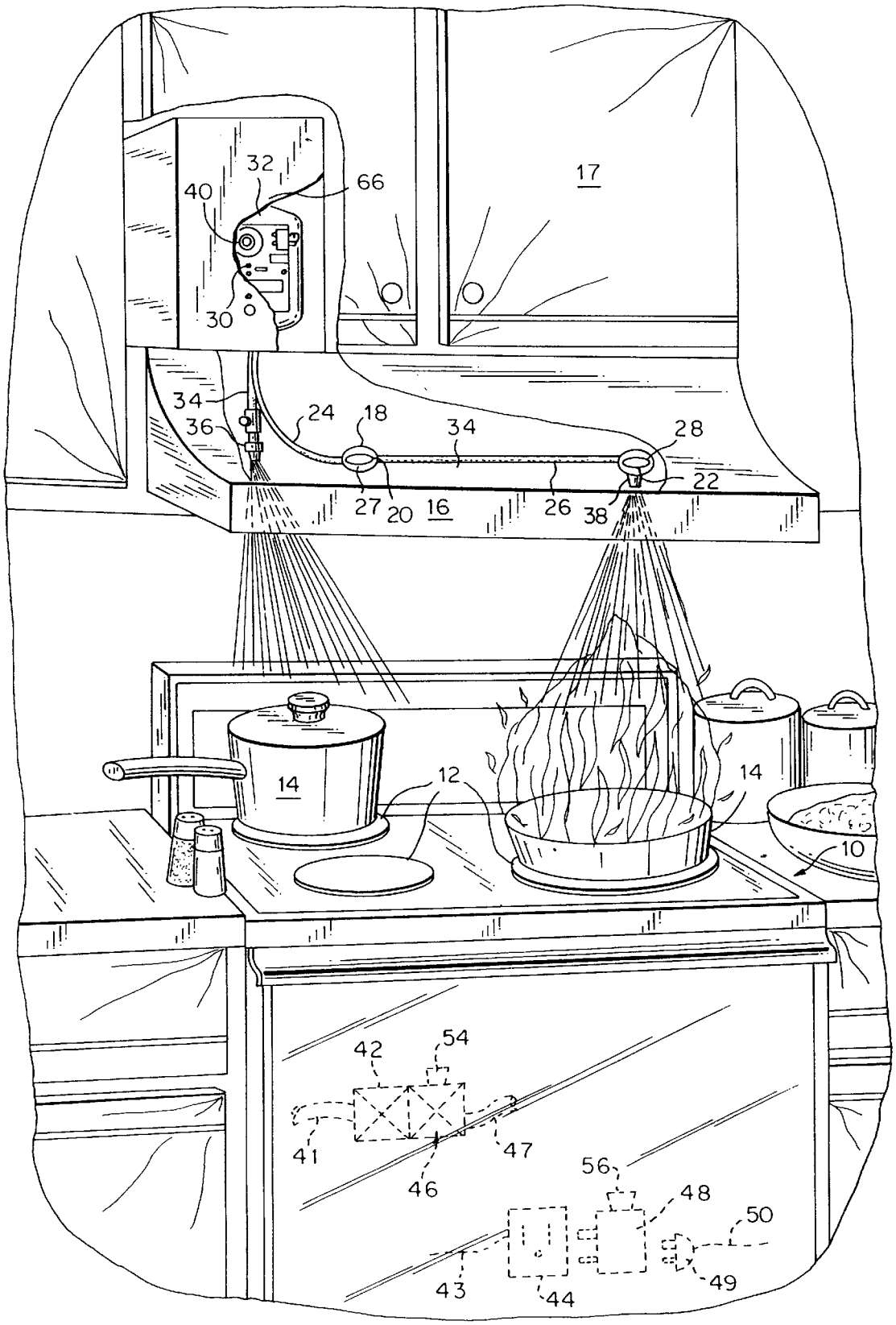
FIG. 1 is a pictorial view of a fire extinguishing system configured in accordance with the principles of the instant invention as used with a residential cook stove.
Figure 2:
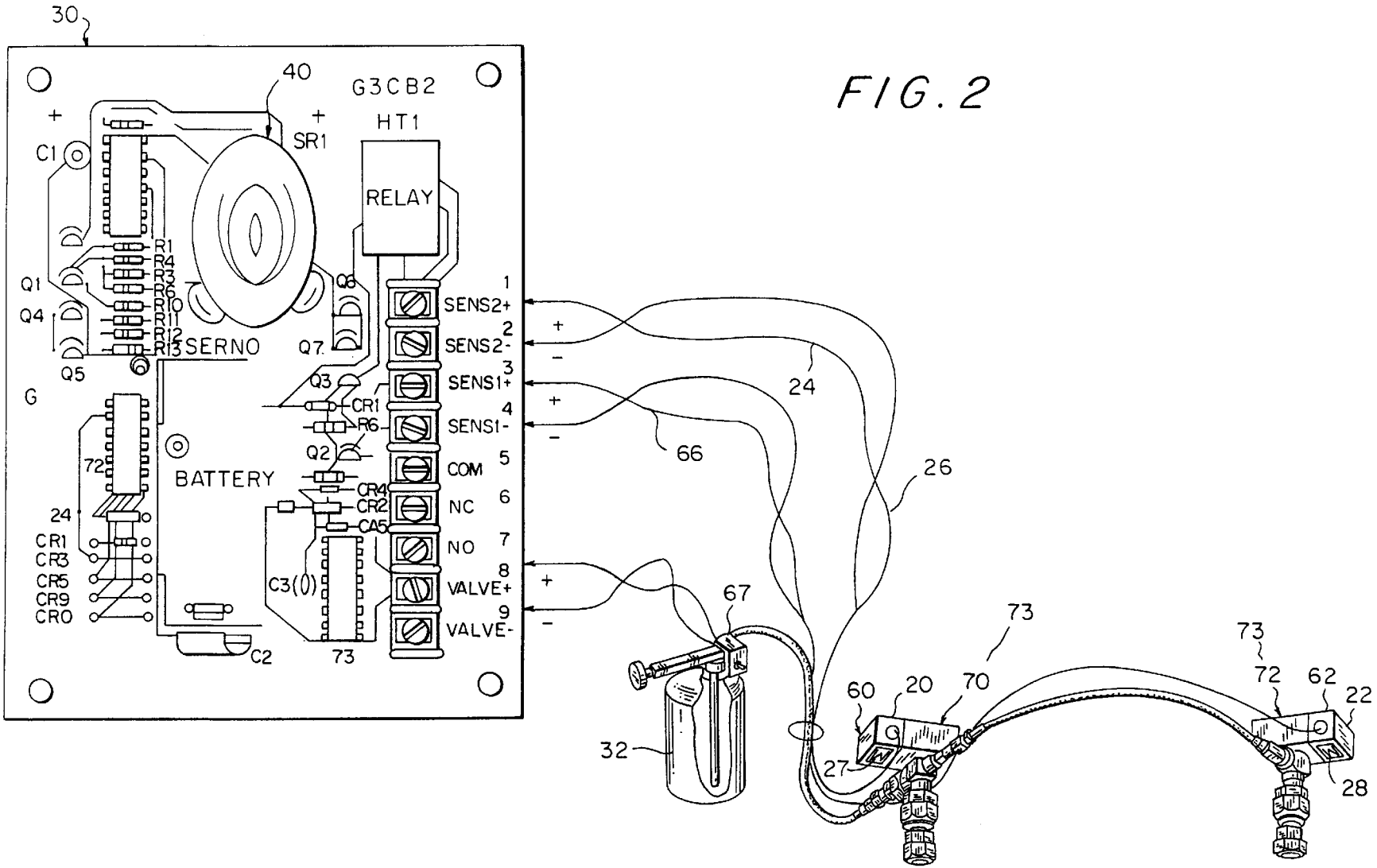
FIG. 2 is a diagrammatical illustration of the components of the system employed in FIG. 1.
Figure 3:
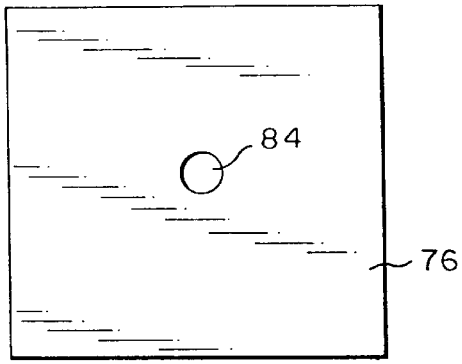
FIG. 3 is a top view of a housing containing a permanent magnet for attaching a nozzle fitting to a stove hood.
Figure 4:
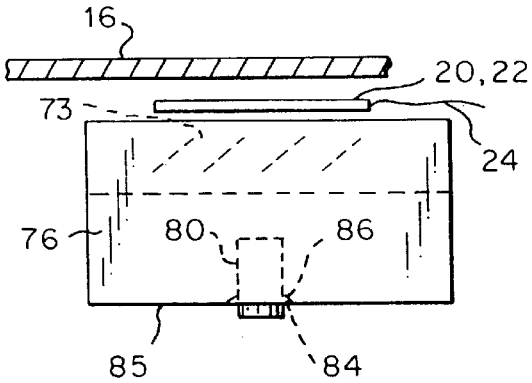
FIG. 4 is a side view of the housing of FIG. 3 showing in dotted lines a permanent magnet and a stud from a fitting secured therein by a lock washer.

FIGS. 1 and 2

FIG. 1 depicts a residential range cook-top, designated generally by the numeral 10, which has four burners 12 thereon for cooking food in pans or pots 14. Disposed above the cook-top stove 10 there is a range hood 16 attached to a cabinet 17.

In accordance with the principles of the present invention, mounted within hood 16 are heat sensor sub-assemblies 20 and 22, connected by leads 24 and 26 to an electric control circuit 30 disposed within cabinet 17. Note that two heat sensors 27 and 28 (preferably part nos. 305-A and 305-B) are shown as are preferably used in residential systems; however, the number of heat sensors could vary depending upon the specific application. The electronic control circuit 30 is housed either with or proximate a canister of fire extinguisher material 32 which is connected by a tubular line 34 to first and second dispensing nozzles 36 and 38. Note that two dispensing nozzles are shown, as is preferable in residential systems; however, the number could vary depending upon the specific application.

When a pan 14 containing food is left on a burner 12 of the stove with the burner on and forgotten about, moisture may evaporate from the pan and the grease or other food in the pan may ignite. If this occurs, the electrical properties of heat sensors 20 and 22 change due to the elevated temperature caused by the fire. The heat sensors 20 and 22 are connected over lines 24 and 26 to the control circuit 30 allowing the control circuit to sense the elevated temperature caused by the fire. When an elevated temperature representative of a range top fire is sensed by the control circuit 30, the control circuit transmits a signal which opens the valve of the fire extinguisher 32 causing fire extinguisher fluid to discharge through the tubular line 34 to the first and second nozzles 36 and 38.

In accordance with the present invention, the heat sensor sub-assemblies 20 and 22 are either thermistors (resistive devices that have a resistance proportional to temperature), diodes (conductive devices that have a forward voltage proportional to temperature), or an active temperature sensor (a sensor or sensor circuit which has a voltage, current or resistance output proportional to temperature). In a preferred embodiment, the heat sensors 20 and 22 are diodes.

Upon the occurrence of a fire, the electronic control circuit 30 activates an audible alarm 40 which emits a high decibel signal to alert occupants of the fire.

The electronic control circuit 30 also preferably contains an auxiliary relay providing the capability for activating remote devices such as emergency power shut-offs, emergency lighting, security systems, automatic telephone dialers, or wide area alarm systems. These remote devices may be wired directly to the relay, or the relay could activate an auxiliary circuit to transmit low level RF, ultrasonic sound, infra-red or laser to be used as a trigger. Additionally, these remote devices may be triggered by detecting the sound signature of the audible alarm 40.

As is seen in FIG. 1, if the stove is a gas stove 10, then behind the cook-top range is a gas line 41 with a conventional, manually operated gas valve 42 for providing the range with cooking gas. In accordance with the principles of the present invention, a supplemental gas shut-off valve assembly 46 is attached to a gas line 47 supplying the stove 10.

Figure 10:
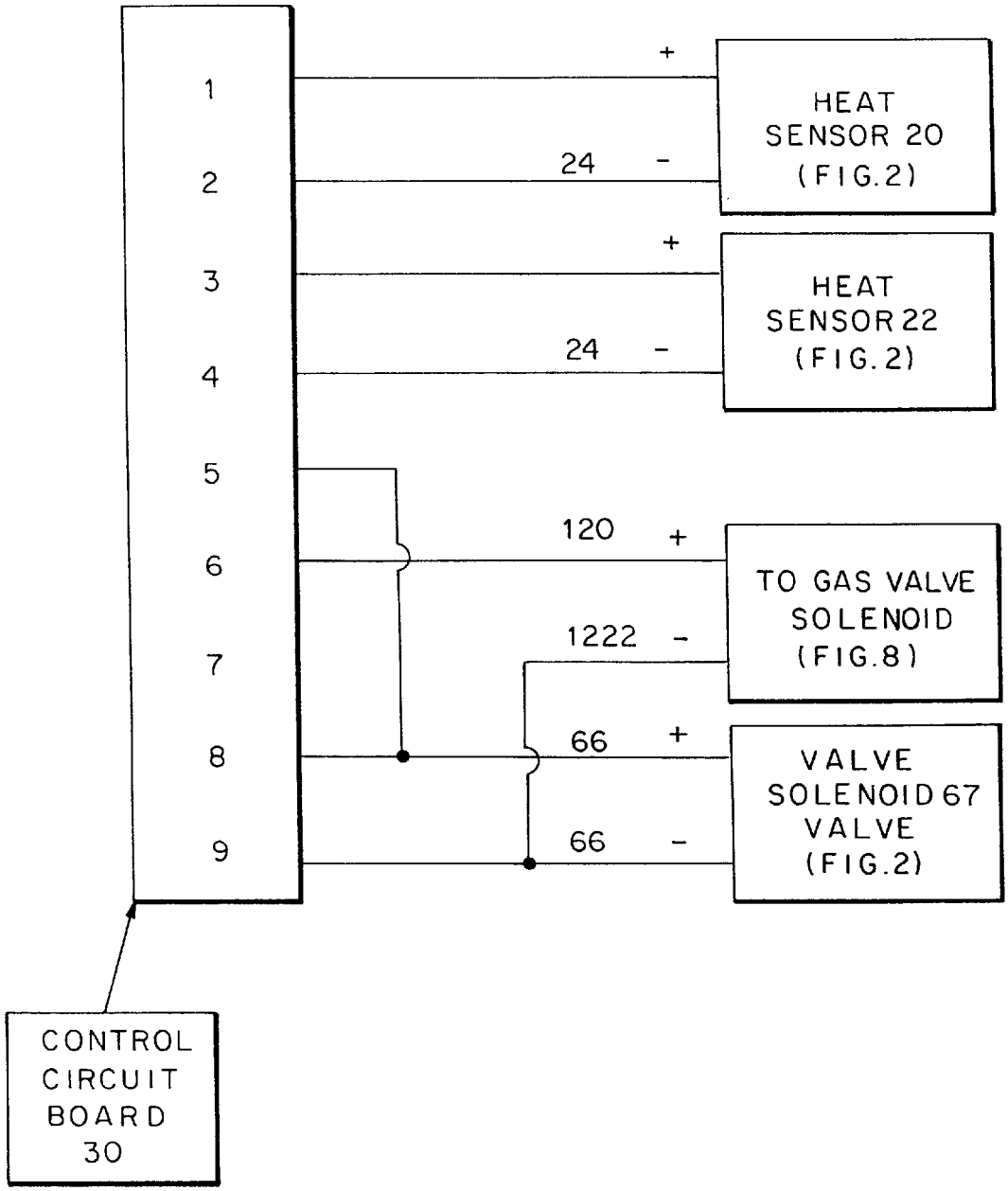
FIG. 10 is an installation diagram showing interconnection wiring when it is desired to hard wire to the gas valve solenoid instead of using the sonic activated cut-off assembly.

The gas shut-off valve assembly 46 may be activated by an optional, internal, acoustically activated electronic circuit capable of detecting the sound signature of the electronic control circuit audible alarm 40 (see FIG. 8) or it may be wired directly to the electronic control circuit 30 (see FIG. 10). The acoustic circuit of FIG. 8 is preferred. As will be explained in detail hereinafter, the optional acoustic activated electronic circuit contains a sound pick-up and circuitry to differentiate between the signal of the audible alarm 40 and other sounds. The circuitry is battery powered by a battery B1 (see FIG. 7) with a life of at least one year and contains a low battery detection circuit with an audible low battery alarm.

As is seen in FIG. 1, if the stove is an electric stove 10, then behind the cook-top range is an electric house current AC line cord 50 with a plug 49 allowing connection to a conventional electric wall outlet 44. In accordance with the principles of the present invention, a supplemental electric shut-off contactor assembly 48 is installed between the stove plug 49 and the wall receptacle 44. As will be explained in detail hereinafter, the electric shut-off contactor assembly 48 may be activated by an optional, internal, acoustically activated electronic circuit capable of detecting the sound signature of the electronic control circuit audible alarm 40 (see FIG. 9) or it may be wired directly to the electronic control circuit 30 (see FIG. 1). The optional acoustic activated electronic circuit is preferred and contains a sound pick-up and circuitry to differentiate between the audible alarm 40 signal and other sounds. The circuitry is powered by the AC line.

Referring now to FIG. 2 wherein the various components of the system are illustrated in further detail. The extinguisher discharge nozzle assemblies 70 and 72 are attached to the underside of the range hood with permanent magnets 73. This means of attachment allows for ease of installation and allows the proper positioning of the nozzle assembly for specific applications. The heat sensor sub-assemblies 20 and 22 are each mounted in a metal housing 60 and 62. In accordance with a preferred embodiment, each of the metal heat sensor housings 60 and 62 are positioned against the side of a nozzle assembly 70 and 72, and held in place by magnetic force of one of the magnets 73. The heat sensors 20 and 22 are electrically connected to the control circuit 30 by wiring 24 having high temperature insulation such as teflon. The control circuit 30 is connected by electrical wiring 66 to a valve 67 which, when activated, opens to release fire suppressant from the fire extinguisher canister 32. The audio alarm 40 emits an audio signal to draw attention to the hazardous condition causing the alarm, and, if the preferable acoustic activated cut-off device is used, the audio alarm 40 causes a cut-off of gas or electricity to the stove 10.

While an acoustic system is preferred, other wireless links may be employed. For example, RF links, optical links (both visible and invisible) and fiber optic links may be used. In some situations, a wired link may have to be employed due to specific regulations. With these alternative links, features other than the wireless link feature distinguish the present invention.

FIGS. 3, 4, 5 and 6

Referring now to FIGS. 3–6, there is shown an embodiment of a two inch square, one inch thick magnetic housing 76 for mounting the magnet 73 as for mounting well as a tee fitting 77 and a 90 degree elbow fitting 78. The tee fitting 77 supports the nozzle 72 while the 90 degree elbow fitting 78 supports the nozzle 70. Each of the fittings 77 and 78 have a stud 80 which is retained within one of the housings 76 by a self-locking washer 82. Each of the sensors 20 or 22 is disposed between one of the housings 76 and the steel hood 16 (FIG. 1) so that the magnet 73 retains the entire assembly against the hood at the desired or proper location.

The studs 80 on the fittings 77 and 78 are ⅜"–¼" and ⅛"–1" long, non-flanged, either not threaded or threaded, bevelled or unbevelled, preferably steel, studs which are welded to the top of the fittings using a capacitor discharge stud welder. The alloy material of the studs 80 could also be stainless steel, brass, aluminum or any other suitable material.

In a preferred embodiment, the magnets 73 are magnets manufactured by Master Magnetics, Inc., (part #07207) and are rated at 100 lbs. pull. The magnet housings 76 are 2" long×2" wide×1" thick and are zinc chromate plated with ¼" hole 84 centered in the top of the housing. If necessary, corresponding magnets of other sizes and ratings as well as magnets from other manufacturers can be used.

Figure 5:
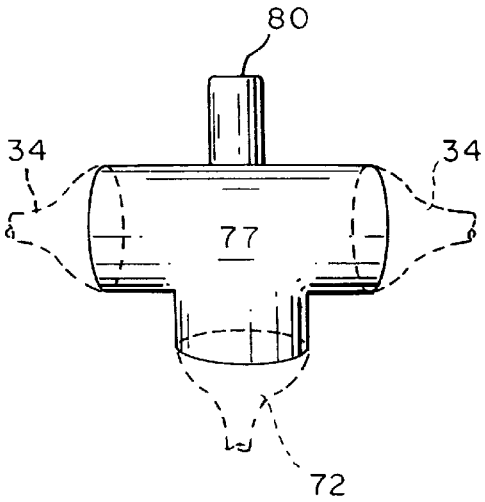
FIG. 5 is a side view of a tee fitting used to connect a fire suppressant nozzle to inlet and outlet fire suppressant hoses, the fitting including a stud for receipt in the housing of FIGS. 3 and 4.
Figure 6:
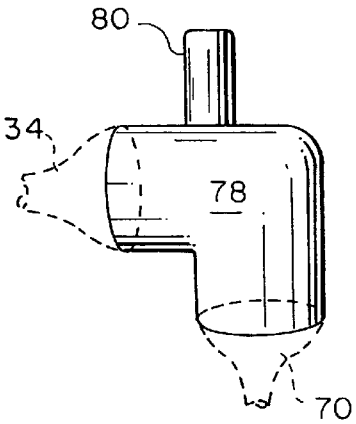
FIG. 6 is a side view of a 90 degree elbow fitting for connecting a fire suppressant nozzle to an inlet fire suppressant hose, the fitting including a stud for receipt in the housing of FIGS. 3 and 4.

The discharge hose assemblies of FIGS. 5 and 6 are secured to the magnet housing 76 at the tee and 90 degree elbow by pushing the ⅜" to ¼" non-threaded or threaded bevelled or unbevelled stud 80 into the ¼" hole 84 in the magnet housing until tee and 90 degree elbow are flush against the surface 85 of the magnet housing. The stud 80 is then secured on the inside of the magnet housing with the self locking washer 82, which holds the discharge assembly secure, but still allows assembly to pivot to relieve stress/torque along the discharge hoses.

This method of attachment allows for ease of installation of the entire discharge hose assembly underneath the range hood without having to measure for drill holes. This method saves considerable time and labor during installation since the hoses 34 (FIGS. 1 and 2) are flexible and can pivot, if required, to circumvent various obstacles underneath the range hood, i.e., lights, fan/filter housings, etc. Moreover, the heat sensor housings 62 and 63 may also be attached to magnet housings 76 through magnetic force. This eliminates the labor involved in measuring for drilling holes as is done in traditional installations of the heat sensor housings in hoods since all one need do is attach the heat sensor housings 62 and 63 against the bottom of the hood 16 and the side of the magnetic housings 76 to hold the assembly in place with magnetic force.

The magnetic mounting arrangement of FIGS. 3–6 is useful for many applications such as, for example, suppressing excessive heat in machinery which might lead to fires or explosions. In such arrangements, a nozzle 70 or 72 and a heat sensor sub-assembly 20 or 22 are positioned in proximity to the machinery or other item or component which is being heated or which, for that matter, is heating the proximate environment. The device, according to the present invention, may thus be employed in engine compartments or proximate any device which may overheat.

FIG. 7

Figure 7:
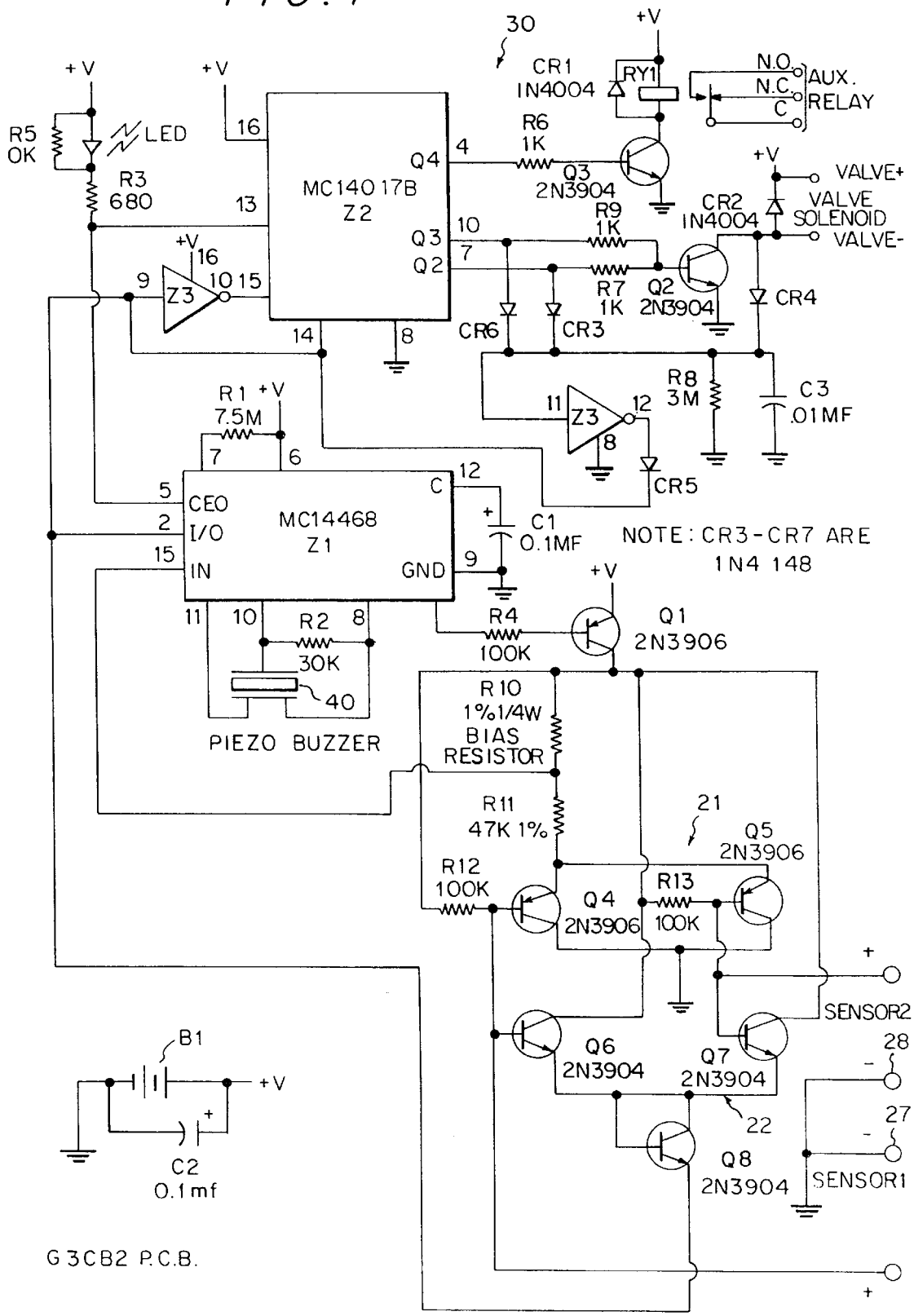
FIG. 7 is a schematic diagram of a control circuit employed in the system of FIG. 1.
Figure 8:
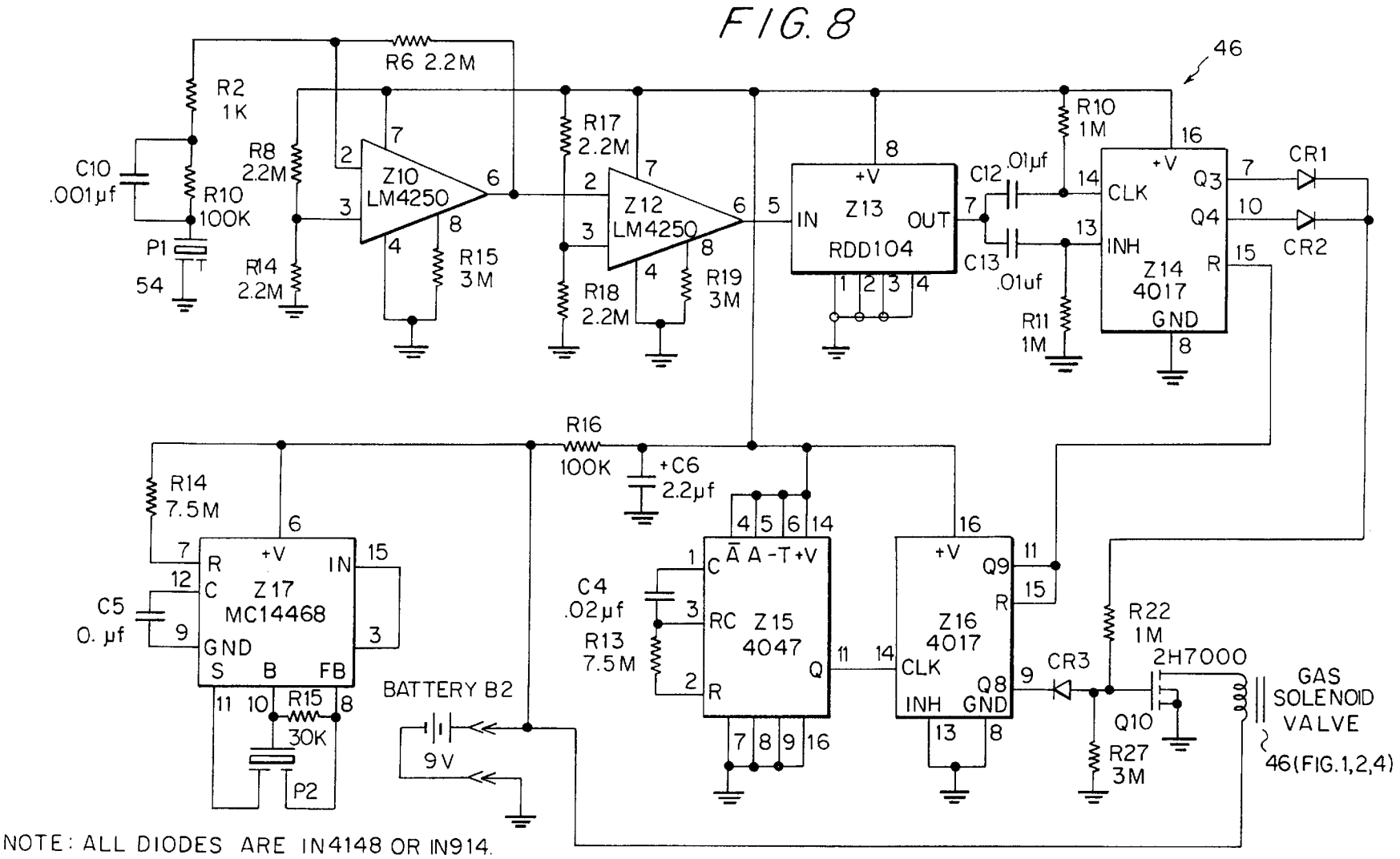
FIG. 8 is a schematic diagram of a sonic activated gas cut-off assembly employed in the systems of FIG. 1.

Referring now to FIG. 7, FIG. 7 is a schematic diagram of the control circuit "30" employed in the system of FIG. 1. The electronic control circuit 30 includes a nine volt battery B1 which is connected in parallel with a capacitor C2 (0.1 F) and provides an output voltage +V applied to various components of the electronic circuitry 30 shown in FIG. 7. The control circuitry 30 includes a first integrated circuit Z1 which is substantially similar to the integrated circuit used in smoke detectors and is preferably part number MC 14468. The integrated circuit Z1 includes an internal oscillator which provides a clock pulse with a period of approximately 1.16 seconds during non-alarm conditions. Every 24 clock cycles, the impedance to common from Z1 pin 5 drops loading the battery B1 through R3 and an LED1. During the time the battery B1 is loaded, an internal reference voltage is compared to the +V battery voltage. If the loaded battery voltage drops below approximately 7.5 volts, the audio alarm 40 chirps. Except when the battery B1 is being checked, during each clock cycle, internal power is applied to the entire integrated circuit Z1 causing the input voltage on pin 4 to be lower than V+ resulting in transistor Q1 (2N3906) turning on and providing power to the heat sensor circuitry (Q4–7, R10–13, and the two heat sensor sub-assemblies 20 & 22 which are connected to the terminal strip pins 1,2 and 3,4 (FIG. 2). As the temperature surrounding the heat sensor sub-assemblies 20 and 22 rises, the voltage drop across the sensors in the heat sensor sub-assemblies 20 and 22 decreases affecting the voltage feedback to pin 15 of Z1. If the feedback-voltage to Z1 pin 15 is less than an internal preset reference, the integrated circuit Z1 enters the alarm state sounding the alarm 40.

The heat sensor sub-assemblies 20 and 22 comprise 4 series-connected silicon diodes each preferably part number 1N4148. When Q1 switches on, current flowing through resistor R12 and R13 into the diodes causes a temperature-dependent voltage to appear at the bases of transistors Q4–Q6.

The emitter voltage of the Q6–Q7 transistor pair is presented to Z1–2 through diode-connected transistor Q8. During normal temperature sensing operation, this voltage is sufficiently low that Q8 is reversed biased and therefore has no effect on circuit operation. However, if one or both sensor sub-assemblies 20 and 22 become open circuited, the voltage is pulled toward V+ which causes Z1–2 to enter the supervisory alarm state.

In the alarm state, the clock pulse period within the integrated circuit Z1 decreases to 40 milliseconds and the alarm 40, which is a piezoelectric horn, sounds with a frequency of approximately 3200 hertz and a duty cycle of approximately 100 milliseconds on and 60 milliseconds off. During the 60 milliseconds time interval when the horn 40 is off, the temperature sensed by the heat sensor sub-assemblies 20 and 22 is again checked, allowing an exit from the alarm state if the temperature has been reduced below the set point. Pin 2 of integrated circuit Z1 represents the alarm state and is high in the alarm state and low when not in the alarm state. When the integrated circuit Z1 is in the alarm state, the low battery alarm is inhibited, but the LED1 pulses approximately once per second.

Connected to pin 5 and pin 2 of the integrated circuit Z1 is a second integrated circuit Z2 which is preferably part number MC14017 or 4017. Integrated circuit Z2 has three input pins which are affected by the alarm state of integrated circuit Z1. When the alarm state occurs, Z2 pin 15 which is the reset input is driven low; Z2 pin 14, the clock input which functions as an enable input, is driven high; and Z2 pin 13, the enable input which functions as a clock input, toggles once per second as the LED1blinks. Subsequent to the first pulse for one second, the Z2 pin 4 output becomes active for 1 second and turns on power transistor Q3 (2N3904) through R6 activating relay RY1 and causing a contact closure of approximately one second. This contact closure output from RY1 is connected to terminal strip pins 5, 6 and 7 (see FIG. 2) allowing external equipment to be activated in the event an alarm occurs. Approximately one second after the Z2 pin 4 becomes active, Z2 pin 7 becomes active, turning on transistor Q2 (2N3904) through R7 which draws current through the impulse activated extinguisher solenoid valve 33 via terminal strip pins 8 and 9 which connect the fire extinguisher 32 to the tubular discharge line 34 (see FIG. 2).

As a safety measure, Q2 is kept on for and additional 1 second interval (2 seconds total) by the next sequential 1-second pulse output from Z2–Z10 through R9.

A third integrated circuit Z3, preferably part number MC14106 or CD40106, is a hex invertor and is used to invert the logic state of a signal where necessary.

The resistor R3 (680) sets the current through the LED1 to approximately 10 milliamperes for the 10 milliseconds duration of the battery check to monitor the internal resistance of the battery B1 and provide a more accurate check of the battery.

Resistor R5 (10K) is used to pull up the voltage at Z1–5 and Z2–13 to +V while the LED is off.

Battery life of the battery 40 is improved by interrupting power to the heat sensor sub-assemblies 20 and 22 and circuitry associated with transistor Q1 except during the time the input to integrated circuit Z1 pin 15 is actively monitored.

Resistor R8 (3M) causes a trickle current of approximately three microamps to continuously flow through the impulse activated extinguisher solenoid valve 46. Should the solenoid valve 46 open, or the wiring to the solenoid valve be cut, resistor R8 causes the input to Z3 pin 9 to be low and the output of Z3 pin 8 to be high. This Z3 pin 8 output is connected to Z1 pin 2 via diode CR5. When Z1 pin 2 is forced high, the horn 40 sounds indicating a fault condition has occurred. Diode CRS prevents the output of Z3 pin 8 from affecting normal circuit operation when Z3 pin 8 is in its normal low state. Diodes CR3, CR4, and capacitor C3 prevent the fault detection circuit from activating while Z2 output is changing state during an alarm sequence operation. Transistor Q8 allows the output voltage of Q1 and the temperature sensor circuitry to bring Z1 pin 2 high if the connection to either of the heat sensor assemblies 20 or 22 opens, again sounding horn 40 indicating a fault condition.

The system operates in the "supervised mode"; meaning if a system or system component fails there will be an alarm output by horn 40 and the LED will flash once per second. When the system is in the supervised mode, the fire extinguisher 32 will not dispense suppressant. If one of the temperature sensors 27 or 28 malfunctions, the system enters a supervised alarm mode. In the event of a fire, the other of the sensors 27 or 28 detects the fire and system still operates to extinguish the fire. This function allows the system to police itself for system malfunctions, while also alerting the user to the system malfunction. The system is also able to detect a fire and extinguish the fire while in the supervised mode of operation.

FIG. 8

FIG. 8 is a schematic diagram of the sonic activated gas cut-off assembly "46" employed in the systems of FIGS. 1 and 2. The purpose of the electronic circuit shown in FIG. 8 is to shut off the gas supply by closing solenoid valve 46 in the event the piezoelectric horn or alarm 40 (FIGS. 1, 2 and 7) on the control circuit board 30 sounds, indicating an alarm condition has occurred.

The audio signal from the alarm 40 is detected by a piezoelectric device P1 used as a microphone 54. Resistor R10 (100K) and capacitor C10 (0.001 F) form a passive filter to attenuate frequencies outside the desired range. Integrated circuits Z10 and Z12, part number LM4250, are low power programmable operational amplifiers, used to amplify and square the input signal from microphone P1. Resistors R15 (3M) and R19 (3M) are used to program the current drain required by integrated circuits Z1 and Z2, respectively Resistors R13/R14 (2.2M) and R17/R18 (2.2M) are for biasing the input reference to the operational amplifiers. Resistors R12 (1K) and R16 (2.2M) are used to set the gain of operational amplifier Z1.

The output of the integrated circuit Z12 is connected to a third integrated circuit Z3, part number RDD104. Integrated circuit Z3 divides the input frequency present at pin 5 by 10,000 and provides a pulse output on pin 7.

Capacitors C12 (0.01 F) and C13 (0.01 F) are used to integrate the pulse from the output of integrated circuit Z3 into two separate inputs of a fourth integrated circuit Z14, preferably part number MC14017 or 4017. These two separate inputs occur on opposite transitions of the input pulse causing an integrated circuit Z14, preferably part number 4017, to count each pulse.

A fifth integrated circuit Z15, preferably part number MC14047 or 4047, is connected to function as a square wave generator with a frequency set by capacitor C14 (0.02 F) and resistor R23 (7.5M). The output pulses from pin 11 of integrated circuit Z15 are used as a clock input to a sixth integrated circuit Z16, preferably part number MC14017 or 4017.

The pin 9 output of integrated circuit Z16 is held low until the eighth clock pulse on pin 14 when the output goes high for one clock duration. The ninth clock pulse on pin 14 causes the output on pin 11 to go high, resetting both integrated circuits Z16 and Z14.

Integrated circuit Z14, as mentioned above, counts on each of two separate inputs. If three or four input pulses are counted between reset pulses, the respective output on pin 7 and pin 10 will toggle high for the duration of one count, or until receiving a reset pulse from integrated circuit Z16 pin 11.

When integrated circuit Z14, pin 7 or 10, and integrated circuit Z16 pin 9 goes high at the same time, transistor Q10 (2N7000) gate is pulled high through resistor R22 (1M) turning on the transistor and actuating the gas solenoid valve 46 (FIG. 1) to turn off the gas to the stove 10. The timing is set to trigger on the frequency and duty cycle (signature) of the audible alarm 40. A higher frequency, if it were past by the operational amplifier circuitry, or a constant signal would cause integrated circuit Z14 to count past the fourth pulse before integrated circuit Z16 pin 9 goes high, preventing an improper gas cut-off. A lower frequency, if it were past by the operational amplifier circuitry, would not cause integrated circuit Z14 to count up to the first output on pin 7, again preventing an improper gas cut-off. Resistor R27 (3M) maintains a low level on the gate of transistor Q10 until it is driven high by one of the two outputs of integrated circuit Z14.

Power for the circuitry is supplied by a nine volt battery B2, resistor R26 (110K) is used to reduce current consumption, capacitor C16 (2.2 F) is used to filter the dc current. Integrated circuit Z17, preferably part number MC14468, is used to monitor the battery voltage. When the battery B2 is near the end of its life, piezoelectric horn P2 will chirp to indicate the low battery condition.

FIG. 9

Figure 9:
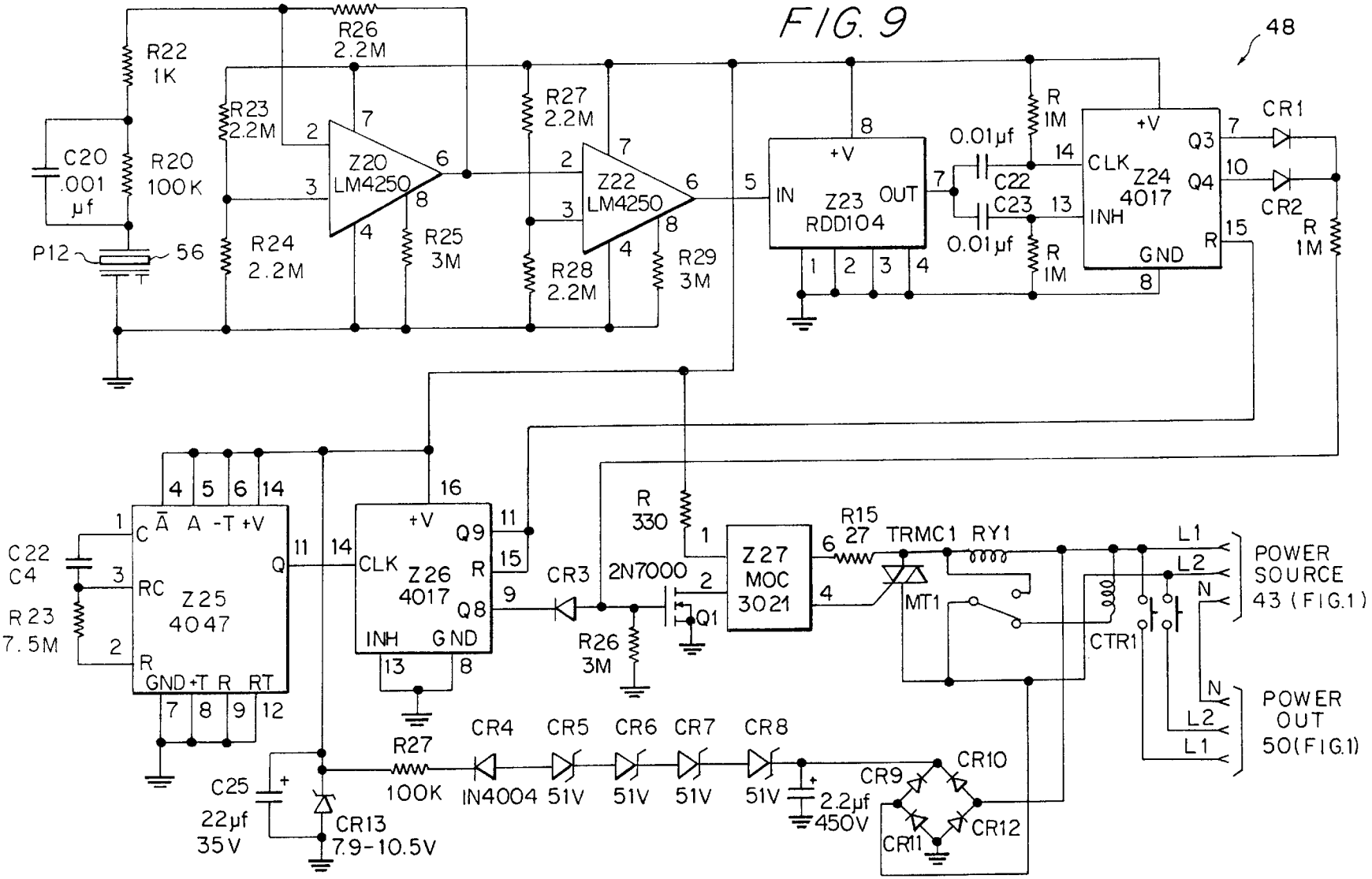
FIG. 9 is a schematic diagram of the sonic activated switch electric cut-off assembly employed in the systems of FIG. 1.

FIG. 9 is a schematic diagram of the sonic activated electric cut-off assembly 48 employed in the systems of FIG.

1. The purpose of the electronic circuit shown in FIG. 9 is to shut off the electric power to the stove top in the event the piezoelectric horn 40 on the control circuit board 30 sounds, indicating an alarm condition has occurred. Many of the same components used in the circuit 46 of FIG. 7 are used in the circuit 48 of FIG. 9.

Piezoelectric device P12 is used as a microphone. Resistor R20 (100K) and capacitor 20 (0.001 F) form a passive filter to attenuate frequencies outside the desired range. Integrated circuits Z20 and Z22, preferably part number LM4250, are low power operational amplifiers, used to amplify and square the input signal. Resistors R25 (3M) and R29 (3M) are used to program the current drain required by integrated circuits Z20 and Z22, respectively. Resistors R23/R24 (2.2M) and R27/R28 (2.2M) are for biasing the input reference to the operational amplifiers. Resistors R22 (1K) and R26 (2.2M) are used to set the gain of operational amplifier Z20.

The output of integrated circuit Z22 is connected to a third integrated circuit Z23, preferably part number RDD104. Integrated circuit Z23 divides the input frequency present at pin 5 by 10,000 and provides a pulse output on pin 7.

Capacitors C22 (0.01 F) and C23 (0.01 F) are used to integrate the pulse from the output of integrated circuit Z23 into two separate inputs of a fourth integrated circuit 24, preferably part numbers MC14017 or 4017. These two separate inputs occur on opposite transitions of the input pulse causing integrated circuit Z24 to count each pulse. The circuit 48 of FIG. 9 as thus far described is the space as the circuit 46 of FIG. 7.

The circuit 48 of FIG. 9 now becomes substantially different from that of FIG. 7 because the power source 50 (FIG. 1) rather than a battery B2 (FIG. 8) provides current for the circuit 48 and the circuit 48 operates to interrupt house or restaurant electrical current rather than gas.

A fifth integrated circuit, Z25, preferably part numbers MC14047 or 4047 is connected to function as a square wave generator with a frequency set by capacitor C4 (0.022) and resistor R23 (7.5M). The output pulses from pin 11 of integrated circuit Z25 are used as a clock input to a sixth integrated circuit Z26, preferably by part numbers MC14017 or 4017.

The pin 9 output of integrated circuit Z26 is held low until the eighth clock pulse on pin 14 when it goes high for one clock duration. The ninth clock pulse on pin 14 causes the output on pin 11 to go high, resetting both integrated circuits Z26 and Z24.

Integrated circuit Z24, as mentioned above, count each of two separate inputs. If three or four input pulses are counted between reset pulses, the respective output on pin 7 and 10 will toggle high for the duration of one count, or until a reset pulse from the integrated circuit Z26 pin 11.

When integrated circuit Z24, pin 7 or 10, and integrated circuit Z26 pin 9 go high at the same time, transistor Q21 (2N7000) gate is pulled high through resistor R26 (3M) turning on the transistor Q21 (2N7000) which triggers the output. The timing is set to trigger on the frequency and duty cycle (signature) of the audible alarm 40. A higher frequency, if it were past by the operational amplifier circuitry (Z20, Z22), or a constant signal would cause integrated circuit Z24 to count past the fourth pulse before integrated circuit Z26 pin 9 goes high, preventing an improper cut-off. A lower frequency, if it were past by the operational amplifier circuitry, would not cause integrated circuit Z24 to count up to the first output on pin 7, again preventing an improper cut-off. Resistor R26 maintains a low level on the gate of transistor Q21 until it is driven high by one of the two outputs of integrated circuit Z24.

Transistor Q21, when it turns on, triggers triac driver Z27, preferably part numbers MOC3021 or MOC3041, turning on the triac, relay RY1, and turning off contractor CTR1 thereby removing power to the stove top 10 (FIG. 1).

When the alarm condition no longer exist, momentarily removing the power source will de-energize relay RY1. When the power is again applied, the contractor is energized through the normally closed contacts of relay RY1, again applying power to the stove top 10 (FIG. 1).

Diodes CR4–CR12 (1N4004) form a bridge rectifier, which together with capacitor C6, convert the input power to DC voltage. Resistor R27 (100 K) and zener diodes CR5–CR8 are used to drop excessive voltage to provide the 7.9 to 10.5 volts across zener diode CR13 (7.9–10.5 v) and capacitor C25 (22 F, 35v) providing power for the rest of the circuitry. Preferably diodes CR1–CR3 have part numbers 1N914 or 1N4148 and diodes CR4–CR12 have part numbers IN4004.

FIG. 10

FIG. 10 is an installation diagram showing interconnection wiring when it is desired to hard wire to the gas valve solenoid instead of using the sonic activated cut-off assembly 46. In FIG. 10, it is seen that lines 120 and 122 are connected directly to the gas valve solenoid 124 instead of the acoustic link of FIG. 4 being relied upon. The gas valve solenoid 124 closes the gas line 41 (see FIG. 1).

FIG. 11

Figure 11:
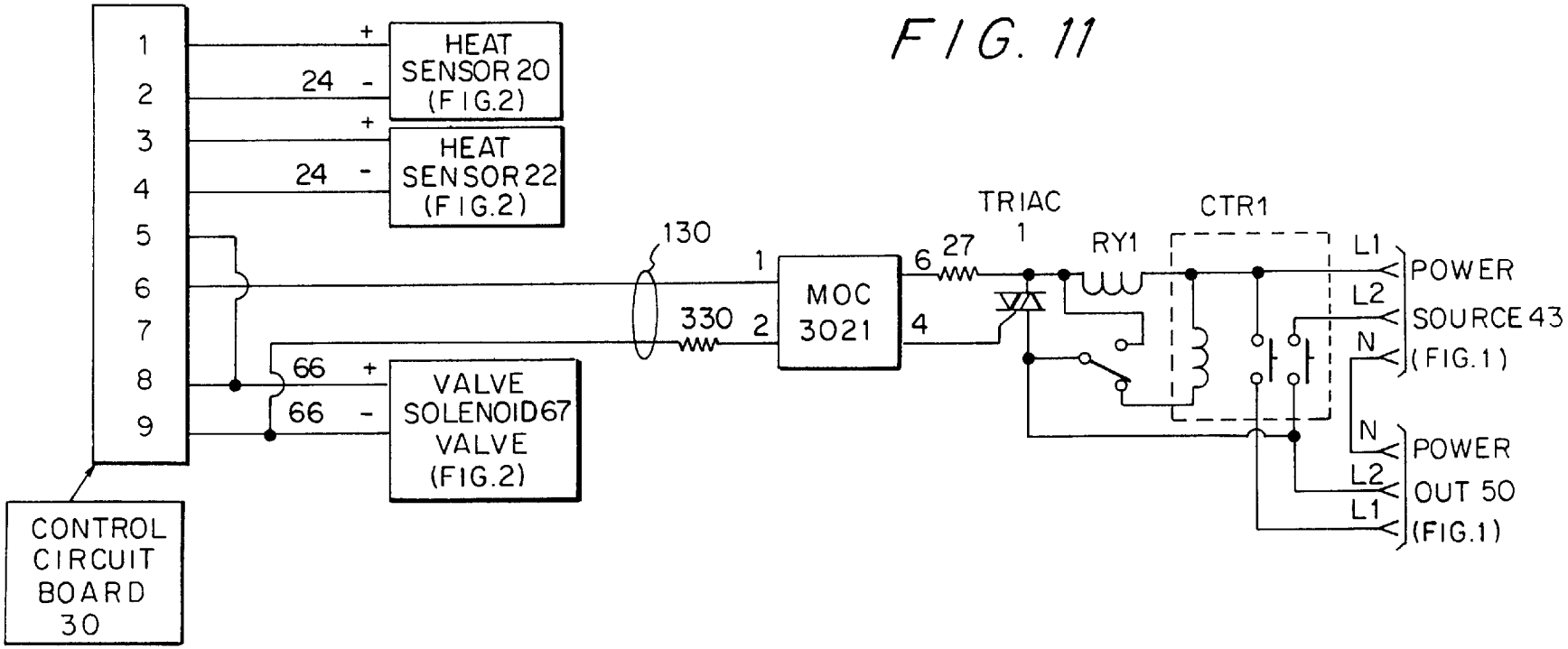
FIG. 11 is an installation diagram showing interconnection wiring and a circuit diagram utilized when it is desired to hard wire the circuit diagram to the electric cut-off, instead of using the sonic activated cut-off assembly.

FIG. 11 is an installation diagram showing interconnection wiring 130 and a circuit diagram when it is desired to hard wire to the electric cut-off instead of using the sonic activated cut-off assembly 48 of FIG. 9. In the embodiment of FIG. 11, the control circuit board triggers 30 the MOC3021 triac driver Z7 (see also FIG. 9) instead of the triac driver being triggered by circuitry driven by the microphone P12 as in the case in FIG. 9. The triac driver Z27 then operates TRIAC 1 to interrupt electrical power to the stove 10 in the same way TRIAC 1 interrupts power in FIG. 9.

FIG. 12

Figure 12:
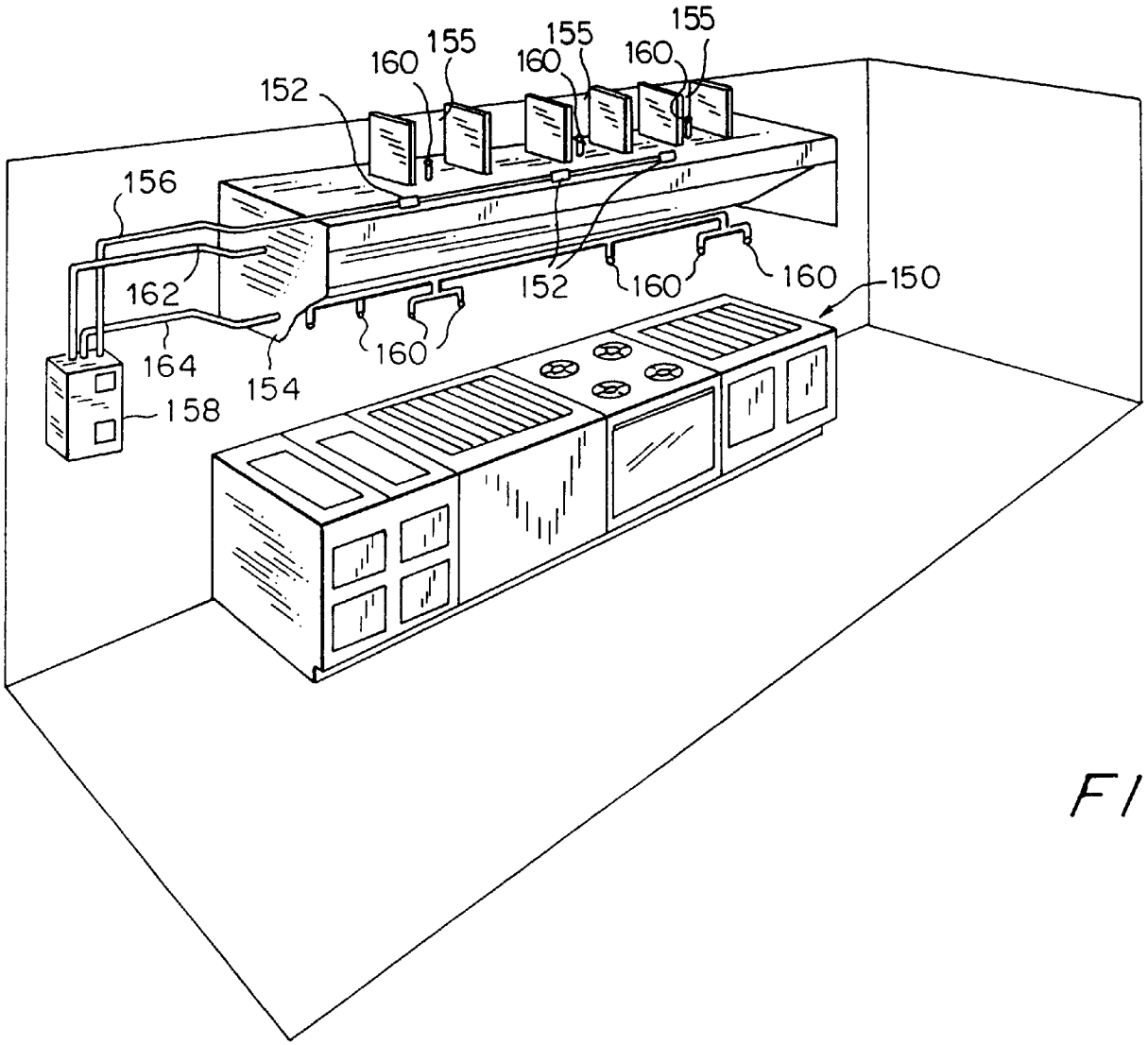
FIG. 12 is a perspective view of a commercial range and range hood for use in restaurants or as an elaborate residential cook stove, which commercial range and range hood includes a control system configured in accordance with the present invention.

Referring now to FIG. 12, there is shown an arrangement in which the system of the present invention, as is set forth in FIGS. 2–11, is used with a commercial range 150 which may include a deep fat frier, burners and grill on a stove top 151.

In the arrangement of FIG. 12, fire detectors 152 similar to the fire detectors 20 and 22 of FIG. 2 are disposed in a commercial hood 154 having exhaust ducts 155. The detectors 152 are preferably mounted by magnets 73 (FIGS. 3–6), but other mounting approaches can be employed if, for example, codes or regulations require other mounting arrangements. The fire detectors 152 are connected by a line 156 to a control box 158 which includes the circuitry of FIG. 7.

In the arrangement of FIG. 12, nozzles 160 are mounted in the hood 154. The nozzles 160 are connected by a discharge piping 162 and 164 to a fire extinguisher within the control box 158. Some of the nozzles 162 are directed toward the range 150 while others of the nozzles 162 are directed to discharge into the exhaust ducts 155 where grease tends to accumulate.

As with the residential system, the connection between the gas supply (or possibly electric power) in the commercial system is preferably accomplished acoustically using the circuitry of FIGS. 8 or 9, but, alternatively, may be wired using the circuitry of FIGS. 10 and 11.

All United States patents cited herein are incorporated herein by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A system for detecting a fire and for interrupting a source of energy to an appliance in response to that detection, comprising:

a sensor for detecting the occurrence of a fire;

an acoustic signal emitter connected to the sensor for emitting an acoustic signal upon the sensor detecting the occurrence of a fire;

an electrical switch connected to the appliance device, but not physically connected to either the sensor or acoustical signal emitter when there is no acoustical signal; and an acoustically sensitive sensor connected to the electric switch for opening the electric switch upon detecting the acoustic signal to interrupt electric current and thus the source of energy to the appliance.

2. The system of claim 1, wherein the sensor is a heat sensor which detects an increased temperature.

3. The system of claim 1, wherein the acoustic signal is an audible alarm signal.

4. The system of claim 1, wherein the sensor and acoustical signal emitter are both powered by a battery.

5. A system for detecting a fire and interrupting a source of energy to an appliance in response to that detection, comprising:

a sensor for detecting the occurrence of a fire;

an acoustic signal emitter connected to the sensor for emitting an acoustic signal upon the sensor detecting the occurrence of a fire;

a valve connected to the appliance but not physically connected to either the sensor or acoustical signal emitter when there is no acoustical signa; and an acoustically sensitive sensor connected to the valve for closing the valve upon detecting the acoustic signal to interrupt flow of gas and thus the source of energy to the appliance.

6. The system of claim 5, wherein the sensor is a heat sensor which detects an increased temperature.

7. The system of claim 5, wherein the acoustic signal is an audible alarm signal.

8. The system of claim 5, wherein the sensor and acoustical signal emitter are both powered by a battery.

* * * * *